United States Patent [19]

Shellenberger

[11] Patent Number: 4,951,651

[45] Date of Patent: Aug. 28, 1990

[54] VENT OVERPRESSURIZATION DETECTION SYSTEM FOR A FUEL-FIRED, INDUCED DRAFT FURNACE

[75] Inventor: Timothy J. Shellenberger, Fort Smith, Ak.

[73] Assignee: Rheem Manufacturing Company, New York, N.Y.

[21] Appl. No.: 413,989

[22] Filed: Sep. 28, 1989

[51] Int. Cl.[5] ..... F24H 3/00

[52] U.S. Cl. ..... 126/116 R; 126/116 A; 431/18; 431/20

[58] Field of Search ..... 126/116 R, 116 A, 112, 126/307 A, 285 B; 431/18, 12, 20, 16, 22; 110/163; 236/1 G, 15 C, 15 BB, 15 BD, 25 R, 25 A

[56] References Cited

U.S. PATENT DOCUMENTS

| | | | |
|---|---|---|---|
| 28,013 | 5/1974 | McLarty | 431/22 |
| 2,913,044 | 11/1959 | Mobley | 431/16 |
| 3,403,962 | 10/1968 | Suffron et al. | 431/20 |
| 3,537,803 | 11/1970 | Ignazio | 431/22 |
| 3,542,018 | 11/1970 | Quick | 431/20 |
| 4,102,627 | 7/1978 | Reed et al. | 431/16 |
| 4,204,833 | 5/1980 | Kmetz et al. | 431/22 |
| 4,289,271 | 9/1981 | Barth | 431/20 |
| 4,355,970 | 10/1982 | Kitagawa et al. | 431/77 |
| 4,401,425 | 8/1983 | Gable | 431/22 |
| 4,708,636 | 11/1987 | Johnson | 431/20 |
| 4,752,210 | 6/1988 | Trent | 431/20 |

FOREIGN PATENT DOCUMENTS

| | | | |
|---|---|---|---|
| 2105888 | 3/1983 | United Kingdom | 431/20 |

*Primary Examiner*—James C. Yeung

*Attorney, Agent, or Firm*—Hubbard, Thurman, Turner, Tucker & Harris

[57] ABSTRACT

In an inducted draft, fuel-fired furnace a flow restriction in the external exhaust flue is detected, and the furnace burners responsively deactivated, by a thermal sensing switch mounted in a spaced relationship with a small flow opening formed in a sensor housing externally secured to the inducer fan outlet section over a wall opening therein. During normal burner combustion product discharge flow through the exhaust flue, a small vane within the inducer fan outlet section creates a venturi therein which draws ambient air within the furnace housing across the temperature sensing switch and into the fan outlet section through the sensor housing opening. The temperature of this ambient air is below the switch set point so that continued burner operation is permitted. However, if the exhaust flue becomes restricted or blocked the resulting pressure increase within the inducer fan outlet section overcomes the venturi effect therein and forces hot burner combustion products outwardly through the sensor housing and across the temperature sensing switch. When the temperature of the switch reaches its set point, the switch operates to deactivate the furnace burners.

20 Claims, 2 Drawing Sheets

VENT OVERPRESSURIZATION DETECTION SYSTEM FOR A FUEL-FIRED, INDUCED DRAFT FURNACE

BACKGROUND OF THE INVENTION

The present invention relates generally to heating apparatus and, in a preferred embodiment thereof, more particularly provides a fuel-fired, induced draft furnace having incorporated therein a vent overpressurization detection system for automatically deactivating the furnace burner(s) in the event that the furnace exhaust flue becomes restricted or blocked.

Many fuel-fired forced air residential heating furnaces utilize draft inducer fans to control the flow of burner combustion products through the furnace heat exchanger. In the typical arrangement, the draft inducer fan has an inlet connected to the heat exchanger outlet, and an outlet section connected to an external exhaust flue such that during furnace operation the draft inducer fan draws burner combustion products through the heat exchanger and discharges the combustion products into and through the external exhaust flue.

Safe operation of the furnace is dependant upon the draft inducer fan delivering the correct amount of combustion air to the furnace burners. If the draft inducer fan delivers an insufficient amount of combustion air to the burners, incomplete combustion will result, thereby causing the burner combustion products to contain unacceptably high levels of carbon monxoide. In the event that the external exhaust flue experiences an internal flow restriction or blockage, this unacceptably high carbon monoxide level in the burner combustion products readily occurs.

The conventional approach to preventing this potentially dangerous situation is to install an electric pressure sensing switch on the flue to continuously monitor the pressure created therein by the draft inducer fan. In the event that an unacceptably high pressure level within the exhaust flue is detected, indicating a restriction in or blockage of the flue, the pressure switch operates to deactivate the furnace burners so that the flue restriction or blockage may be appropriately removed, and the furnace returned to its normal, safe operation.

While the use of an electric pressure switch to detect flue restriction or blockage has proven to be a safe and effective solution to this problem, the incorporation of an electric pressure sensing switch in the typical residential furnace is relatively expensive.

It would accordingly be desirable to provide a vent overpressurization detection system which is less expensive. It is thus an object of the present invention to provide such a system.

SUMMARY OF THE INVENTION

In carrying out principles of the present invention, in accordance with a preferred embodiment thereof, a fuel-fired, induced draft furnace is provided with a vent overpressurization detection system which utilizes a simple and inexpensive temperature sensing switch instead of the conventionally utilized electric pressure switch.

The furnace in which the vent overpressurization system of the present invention is representatively incorporated includes a draft inducer fan connected to the furnace heat exchanger to draw hot burner combustion products therethrough and discharge the combustion products into and through an external exhaust flue via an outlet section of the draft inducer fan which, during burner and inducer fan operation, has a positive internal pressure.

In a preferred embodiment thereof, the vent overpressurization detection system of the present invention includes a small sensor housing suitably secured to the outlet section of the draft inducer fan and positioned over a wall opening therein so that the interior of the sensor housing communicates with the interior of the inducer fan outlet section. A small temperature sensing switch is externally secured to the sensor housing in an outwardly spaced relationship with a small sensing flow opening therein.

During operation of the furnace burners and the draft inducer fan, and normal, substantially unimpeded combustion product discharge flow through the external exhaust flue, an internal venturi vane functions to intercept a small portion of the pressurized combustion products flowing through the inducer fan outlet section and flow such portion at an increased velocity past the juncture of the outlet section and the sensor housing externally mounted thereon.

The increased velocity of the combustion product portion adjacent such juncture creates a small venturi area within the inducer fan outlet section. In turn, this venturi flow area creates a negative pressure within the sensor housing which draws ambient air within the furnace housing across the temperature sensing switch, into the sensor housing through its sensing flow opening, and into the inducer fan outlet section for discharge with the burner combustion products into and through the exhaust flue.

The ambient air drawn into the positive pressure inducer fan outlet section in this manner is at a temperature well below the set point of the temperature sensing switch which is appropriately wired to the furnace burner controls to deactivate the burners when the temperature sensing switch is exposed to a sustained temperature at or above its set point. Accordingly, when the external exhaust flue is essentially free from internal restriction or blockage, the temperature sensing switch permits normal operation of the furnace burners.

However, in the event that a flow restriction is present within the external exhaust flue, the pressure within the flue, and thus in the inducer fan outlet section, rises. When the interior pressure within the inducer fan outlet section is sufficiently elevated by this interior exhaust flue restriction or blockage, the small venturi area within the outlet section is overcome and hot combustion products within the outlet section are forced outwardly into the sensor housing. Hot combustion products entering the sensor housing are forced outwardly through its flow opening and are flowed over the temperature sensing switch into the furnace housing. A continued outflow of hot combustion products across the temperature sensing switch in this manner causes it to reach its set point temperature at which time it deactivates the furnace burners In this manner, a simple temperature sensing switch may be utilized in place of a costlier electric pressure sensing switch to prevent unsafe operation of the furnace caused by internal restriction or blockage of the external exhaust flue.

DETAILED DESCRIPTION

Figure 1:
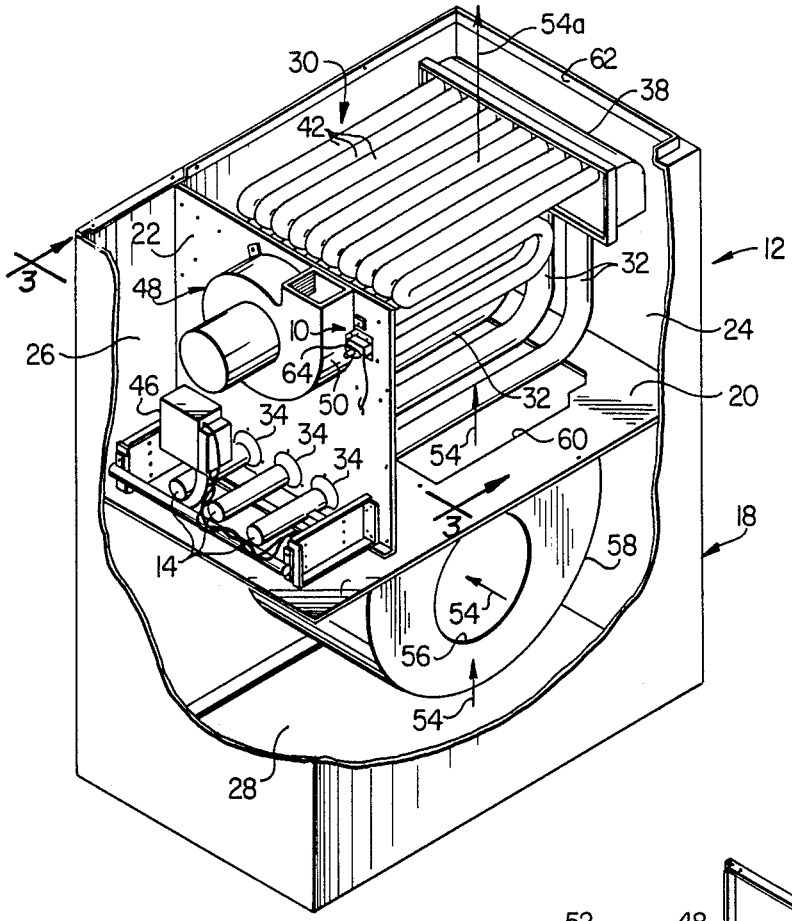
FIGS. 1 and 2 are partially cut away perspective views of an induced draft, fuel-fired furnace which incorporates vent pressure safety detection apparatus embodying principles of the present invention.
Figure 2:
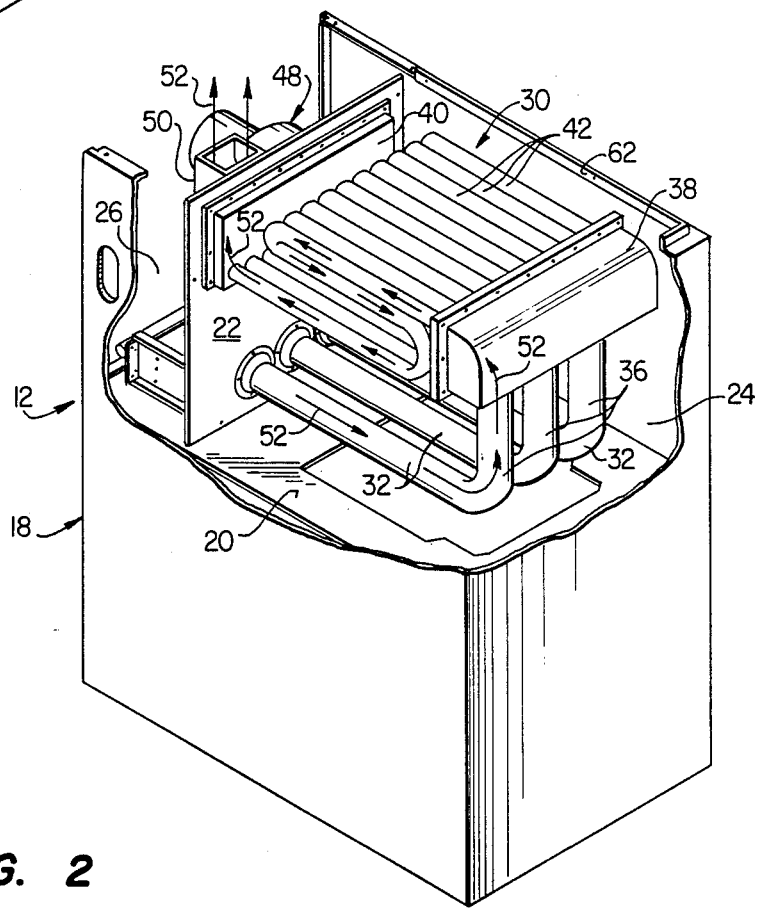
Figure 3:
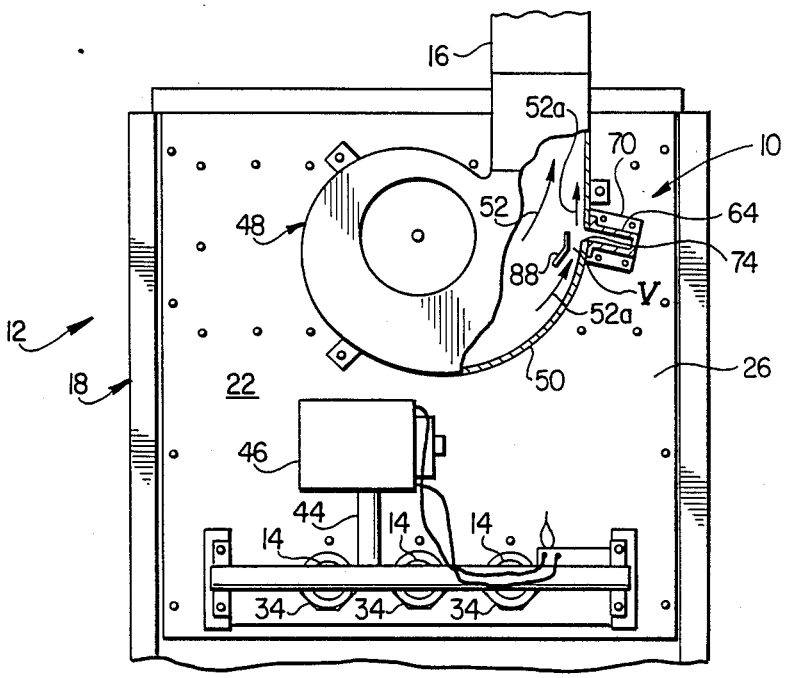
FIG. 3 is an enlarged scale, partially sectioned interior elevational view of the furnace taken along line 3—3 of FIG. 1.

Referring initially to FIGS. 1-3, the present invention provides a vent overpressurization detection system 10 which is representatively incorporated in a fuel-fired, induced draft furnace 12 and is operative, in a manner subsequently described, to terminate operation of the furnace's gas-fired burners 14 in response to a sensed restriction or blockage of an external exhaust flue 16 to which the furnace 12 is operatively connected. The flue 12 may be either vertically or horizontally oriented.

The furnace 12 includes a housing 18 which in interiorly divided, by a horizontal wall 20 and a vertical wall 22, into a supply air plenum 24 and a burner and fan chamber 26 which are positioned above an air inlet plenum 28. Operatively positioned within the supply air plenum 24 is a relatively high pressure drop, high efficiency heat exchanger structure 30 which includes three relatively large diameter, generally L-shaped primary tubes 32 which are secured at their open inlet ends 34 to a lower portion of the interior wall 22. The upturned outlet ends 36 of the primary tubes 32 are connected to the bottom side of a transition manifold structure 38 which is spaced rightwardly apart from a combustion gas collection manifold 40 suitably secured to an upper portion of the interior wall 22. The interior of the manifold 38 is communicated with the interior of the manifold 40 by means of a horizontally spaced series of vertically serpentined secondary tubes 42 each connected at its opposite ends to the manifolds 38, 40 and having a considerably smaller diameter than the primary tubes 32.

The three illustrated main gas burners 14 are horizontally spaced apart from one another, are operatively mounted within a lower portion of the chamber 26, and are supplied with gaseous fuel (such as natural gas), through supply piping 44 (FIG. 3), by a gas valve 46. A draft inducer fan 48 positioned within the chamber 26 is mounted on an upper portion of the interior wall 22 above the burners 14, and has an inlet communicating with the interior of the manifold 40, and an outlet section 50 coupled to the external exhaust flue 16 (FIG. 3).

Upon a demand for heat from the furnace 12, by a thermostat (not illustrated) located in the space to be heated, the burners 14 and the draft inducer fan 48 are energized. Flames and products of combustion 52 from the burners 14 are directed into the open inlet ends 34 of the primary heat exchanger tubes 32, and the combustion products 52 are drawn through the heat exchanger structure 30 by operation of the draft inducer fan 48. Specifically, the burner combustion products 52 are drawn by the draft inducer fan 48, as indicated in FIG. 2, sequentially through the primary tubes 32, into the manifold 38, through the secondary tubes 42 into the manifold 40, from the manifold 40 into the inlet of the fan 48, and through the outlet section 50 of the fan 48 into and through the external exhaust flue 16.

At the same time, return air 54 (FIG. 1) from the heated space is drawn upwardly into the inlet plenum 28 and flowed into the inlet 56 of a supply blower 58 disposed therein. Return air 52 entering the blower inlet 56 is forced upwardly into the supply air plenum 24 through an opening 60 in the interior housing wall 20. The return air 54 is then forced upwardly and externally across the heat exchangers structure 30 to convert the return air 54 into heated supply air **54*a* which is upwardly discharged from the furnace through a top end outlet opening 62 to which a suitable suppy ductwork system (not illustrated) is connected to flow the supply air 54*a*** into the space to be heated.

Referring now to FIGS. 3-6, the vent overpressurization detection system 10 of the present invention is operative to detect an internal restriction or blockage within the exhaust flue 16, during operation of the furnace burners 14 and the draft inducer fan 48, and responsively deactivate the burners 14 to prevent a potentially unsafe condition resulting from insufficient combustion air being delivered to the burners 14.

The system 10 includes a small sensor housing 64 and a temperature sensing switch 66 having a output lead 68 operatively connected to the burners 14 for purposes later described. The sensor housing 64 is suitably secured to the interior housing wall 22 and the inducer fan outlet section 50, for example by means of mounting flanges 70 and 72, and is positioned over a small wall opening 74 (FIG. 3) formed in the outlet section 50 so that the interior of the sensor housing 64 communicates with the interior of the draft inducer fan outlet section 50.

Figure 4:
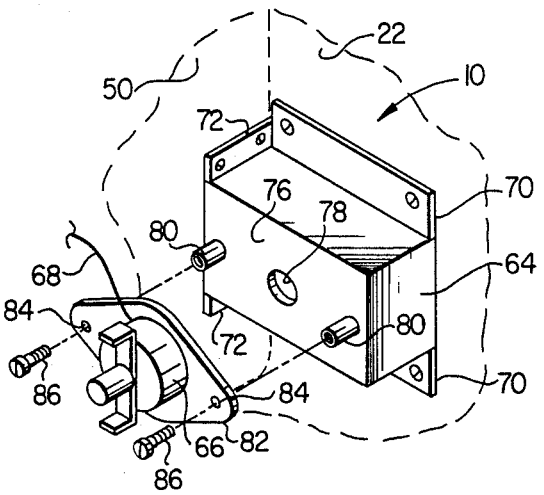
FIG. 4 is an enlarged scale exploded perspective view of the vent pressure safety detection apparatus.
Figure 5:
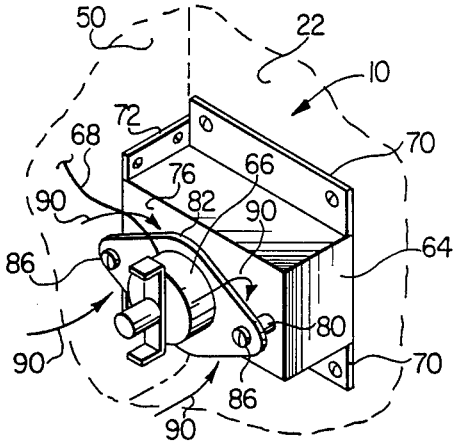
FIG. 5 is an enlarged scale perspective view of the assembled vent pressure safety detection apparatus illustrating its operation when the furnace flue is satisfactorily venting combustion products from the furnace.
Figure 6:
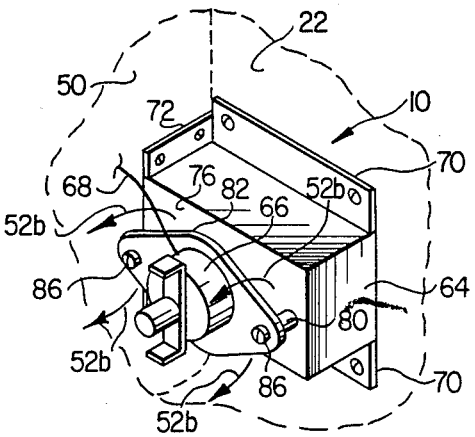
FIG. 6 is an enlarged scale perspective view of the assembled vent pressure safety detection apparatus illustrating its operation in response to a flow restriction or blockage in the furnace flue.

As best illustrated in FIG. 4, a left side wall portion 76 of the sensor housing 64 has a small circular sensing flow opening 78 formed therein, and a pair of internally threaded support post members 80 project outwardly from the side wall 76 on opposite sides of the flow opening 78. The temperature sensing switch 66 is mounted on a base member 82 having a pair of circular openings 84 formed therein and positioned on opposite sides of the temperature sensing switch 66. The base member 82 is mounted on the sensor housing 64 by means of a pair of screws 86 extending through the base member openings 84 and threaded into the support posts 80 to thereby support the temperature sensing switch 66 in an outwardly spaced relationship with the sensor housing flow opening 78 as illustrated in FIGS. 5 and 6.

Referring now to FIG. 3, a small scoop vane 88 is secured within the outlet section 50 of the draft inducer fan 48 adjacent the juncture of the sensor housing 64 with the outlet section 50. During operation of the burners 14 and the draft inducer fan 48, the burner combustion products 52 internally pressurize the outlet section 50 as the combustion products 52 are discharged into and through the external exhaust flue 16. During periods of normal combustion product discharge flow through the flue 16 (i.e., when it is neither restricted nor blocked), the vane 88 functions to intercept a small portion **52*a* of the combustion product flow 52 and direct such portion 52*a*, at an increased velocity, past the juncture of the fan outlet section with the open inner end of the sensor housing 64**.

This increased velocity combustion product flow 52*a* past the inner end of the sensor housing 64 creates a venturi area V adjacent such inner end. The venturi area V, in turn, induces a negative pressure within the sensor housing 64 which, as indicated in FIG. 5, induces a flow of ambient air 90 across the temperature sensing switch 66, into the space between the base member 80 and the sensor housing wall 76, inwardly through the sensor housing flow opening 78, and into the inducer fan outlet section 50 through the interior of the sensor housing 64. Under normal operating conditions, the temperature of the ambient air inflow 90 along the external flow path just described is well below the set point of the temperature sensing switch 66. Accordingly, the temperature sensing switch 66 permits continued operation of the burners 14 as long as the interior of the flue 16 is not restricted or blocked.

However, in the event that the interior of the flue 16 becomes restricted or blocked, the internal pressure within the inducer fan outlet section 50 is correspondingly increased until the elevated pressure therein overcomes the venturi V and creates an outflow 52*b* (FIG. 6) of burner combustion products from the interior of the inducer fan outlet section 50 through the interior of the sensor housing 64. The combustion product outflow 52*b* is discharged through the sensor housing flow opening 78 and is flowed outwardly across the temperature sensing switch 66 as illustrated in FIG. 6. A sustained outflow of combustion products through the sensor housing 64 in this manner elevates the temperature of the switch 66 until it reaches its set point temperature, at which time it generates an appropriate control signal, via the output lead 68, to deactivate the burners 14.

In this manner, the simple and relatively inexpensive temperature sensing switch 66 may be utilized in place of a conventional, and costlier, electric pressure switch to deactivate the furnace burners in response to a restriction or blockage of the external exhaust flue during furnace operation.

While the vent overpressurization detection system of the present invention has been representatively illustrated in a forced air residential heating furnace, it will readily be appreciated that principles of this invention could also be utilized in fuel-fired, induced draft heating apparatus of other types, including, for example, furnaces of other types and configurations, boilers and the like.

The foregoing detailed description is to be clearly understood as being given by way of illustration and example only, the spirit and scope of the present invention being limited soley by the appended claims.

What is claimed is:

1. A fuel-fired, induced draft furnace comprising:

a heat exchanger through which hot combustion products may be flowed;

a burner operative to generate hot combustion products;

a supply air blower operative to flow air externally across said heat exchanger;

a draft inducer fan connected to said heat exchanger and operative to draw hot burner combustion products therethrough, said draft inducer fan having an outlet section connectable to an exhaust flue to discharge hot burner combustion products from said outlet section into and through the exhaust flue, said outlet section having a positive internal pressure during operation of said burner and said draft inducer fan; and safety means for detecting a flow restriction within the exhaust flue, during operation of said burner and said draft inducer fan, and responsively deactivating said burner, said safety means including:

means for creating an inflow of ambient air along an external flow path into said outlet section of said draft inducer fan during normal burner combustion product discharge flow through the exhaust flue, means for terminating said ambient air inflow, and creating an outflow of hot burner combustion products from said outlet section of said draft inducer fan along said external flow path, in response to an increased combustion product flow resistance within the exhaust flue, and temperature sensing means, positioned in said external flow path to sense the temperature therein, for deactivating said burner in response to a sustained outflow of hot combustion products from said outlet section of said draft inducer fan along said external flow path.

2. The furnace of claim 1 wherein:

said means for creating an inflow of ambient air include an opening formed in said outlet section of said draft inducer fan, and means, responsive to operation of said draft inducer fan, for creating a venturi area disposed within said outlet section adjacent said opening therein.

3. The furnace of claim 2 wherein:

said means for creating a venturi area include a vane member secured within said outlet section adjacent said opening therein.

4. Fuel-fired, induced draft furnace apparatus comprising:

heat exchanger means for receiving an internal throughflow of hot combustion products, said heat exchanger means having an outlet portion;

burner means operative to generate hot combustion products;

supply air blower means operative to flow air to be heated externally across said heat exchanger means;

wall means for defining an enclosed combustion product discharge passage extending outwardly from said outlet portion of said heat exchanger means;

fan means for forcibly flowing hot combustion products generated by said burner means through said heat exchanger means and into and through said combustion product discharge passage in a manner creating a positive pressure region in said combustion product discharge passage;

means for inducing an inflow of ambient air along an external flow path into said positive pressure region of said combustion product discharge passage during operation of said burner means and said fan means and normal, substantially umimpeded combustion product flow through said combustion product discharge passage;

means for terminating said ambient air inflow, and creating an outflow of hot burner means combustion products from said positive pressure region along said external flow path, in response to a restriction or blockage of said combustion product discharge passage; and temperature sensing means, positioned in said external flow path, for deactivating said burner means in response to said outflow of hot burner means combustion products.

5. The furnace apparatus of claim 4 wherein:

said means for inducing an inflow of ambient air include an opening formed in said wall means at said positive pressure region, and means for creating a combustion product venturi flow area within said positive pressure region at said wall means opening.

6. The furnace apparatus of claim 5 wherein:

said means for creating a combustion product venturi flow area include a vane member secured within said wall means in said positive pressure region.

7. The furnace apparatus of claim 5 wherein:

said fan means include a draft inducer fan having an inlet connected to said outlet portion of said heat exchanger means, and an outlet section defining a portion of said wall means.

8. The furnace apparatus of claim 7 wherein:

said positive pressure region is disposed within said outlet section of said draft inducer fan.

9. A fuel-fired, induced draft furnace comprising:

a housing having an inlet plenum, a supply air plenum, and a fan and burner chamber therein;

a heat exchanger positioned within said supply air plenum for receiving an internal throughflow of hot combustion products, said heat exchanger having inlet and outlet portions;

a burner positioned within said fan and burner chamber and operative to discharge hot combustion products into said inlet portion of said heat exchanger;

a draft inducer fan positioned within said fan and burner chamber and having an inlet connected to said outlet portion of said heat exchanger, and an outlet section connectable to an external exhaust flue, said draft inducer fan being operative to draw hot burner combustion products through said heat exchanger and discharge said hot burner combustion products into and through the external exhaust flue, said draft inducer fan outlet section having a wall opening therein;

a vane member secured within said draft inducer fan outlet section adjacent said wall opening therein and being operative, in response to operation of said draft inducer fan when the external flue is essentially free of flow restrictions therein, to create a venturi flow area inwardly adjacent said wall opening;

a sensor housing externally secured to said draft inducer fan outlet section over said wall opening therein, the interior of said sensor housing communicating with the interior of said draft inducer fan outlet section through said wall opening therein, said sensor housing having a wall portion with a flow opening therein; and a temperature sensing switch externally secured to said sensor housing in an outwardly spaced relationship with said flow opening to be impinged by a fluid outflow therethrough, said temperature sensing switch being connected to said burner and operative to deactivate said burner in response to sensing a temperature essentially equal to that of hot burner combustion products flowing through said draft inducer fan outlet section.

10. Heating apparatus comprising:

a heat exchanger adapted to receive an internal throughflow of hot combustion products, and externally across which a fluid to be heated may be flowed;

a burner operative to generate hot combustion products;

a draft inducer fan connected to said heat exchanger and operative to draw hot burner combustion products therethrough, said draft inducer fan having an outlet section connectable to an exhaust flue, said outlet section having a wall opening therein and having a positive internal pressure during draft inducer fan operation when said draft inducer fan is operatively connected to the exhaust flue;

means for creating an ambient air inflow into said outlet section, along an external flow path, during normal, substantially unimpeded combustion product discharge flow through the exhaust flue;

means for creating an outflow of hot burner combustion products from said outlet section, along said external flow path, in response to an interior restriction or blockage of the exhaust flue; and means for sensing the temperature of fluid flowing along said external flow path and responsively deactivating said burner when the sensed temperature is substantially equal to the temperature of hot burner combustion products flowing through said draft inducer fan outlet section.

11. The heating apparatus of claim 10 wherein:

said means for creating an ambient air inflow include means for creating a combustion product venturi flow area within said outlet section, adjacent said wall opening therein, during operation of said draft inducer fan.

12. For use in conjunction with a fuel-fired, induced draft furnace having a draft inducer fan connected to a heat exchanger and operative to draw hot burner combustion products through the heat exchanger and discharge them into an exhaust flue through an outlet section of the draft inducer fan, the outlet section having a positive internal pressure during inducer fan operation, a method of deactivating the furnace burner system in response to an internal restriction or blockage of the exhaust flue during furnace operation, said method comprising the steps of:

creating an inflow of ambient air along an external flow path into the interior of the draft inducer fan outlet section during operation of the burner system and the draft inducer fan and normal burner combustion product discharge flow into and through the exhaust flue;

terminating said inflow of ambient air, and creating along said external flow path an outflow of hot burner combustion products from the interior of the draft inducer fan outlet section, in response to an internal restriction or blockage of the exhaust flue during operation of the burner system and the draft inducer fan;

positioning a temperature sensing switch in said external flow path for impingement by said ambient air or said outflow of hot burner combustion products; and utilizing said temperature sensing switch to deactivate the burner system in response to a sustained outflow of hot burner combustion products form the interior of the draft inducer fan outlet section along said external flow path.

13. The method of claim 12 wherein:

said step of creating an inflow of ambient air includes forming a wall opening in the draft inducer fan outlet section and creating a combustion product venturi flow area within the outlet section adjacent said wall opening.

14. The method of claim 13 wherein:

said step of creating a combustion product venturi flow area includes the step of operatively securing a vane within the interior of the draft inducer fan outlet section adjacent said wall opening.

15. The method of claim 13 wherein:

said step of creating an inflow of ambient air further includes securing a sensor housing externally to the draft inducer fan outlet section over said wall opening in a manner communicating the interior of said sensor housing with the interior of the draft inducer fan outlet section, said sensor housing having a flow opening formed in a wall portion thereof, and said step of positioning a temperature sensing switch in said external flow path includes mounting the temperature sensing switch externally on said sensor housing in an outwardly spaced relationship with said flow opening.

16. Draft inducer fan apparatus for drawing hot combustion products through a heat exchanger portion of a fuel-fired heating furnace or the like and discharging the combustion products into an exhaust flue, said draft inducer fan apparatus comprising:

a housing having an inlet opening operatively connectable to the heat exchanger, and an outlet section having an exterior side wall portion with a discharge opening therein for flowing combustion products into the exhaust flue;

motor-driven means for flowing heat exchanger combustion products through said housing from said inlet opening thereof to and outwardly through said discharge opening thereof;

a sensing flow opening formed through said exterior side wall portion of said housing outlet section upstream from said discharge opening;

flow control means, disposed within said outlet section adjacent said sensing flow opening, for drawing a flow of ambient air into said outlet section through said sensing flow opening during operation of said draft inducer fan apparatus with normal combustion product outflow therefrom through the exhaust flue, and for permitting an outflow of combustion products from said outlet section through said sensing flow opening during operation of said draft inducer fan apparatus when combustion product flow through the exhaust flue is impeded or blocked; and temperature sensing means, positioned outwardly adjacent said sensing flow opening, for sensing the temperature of fluid entering or exiting said sensing flow opening during operation of said draft inducer fan apparatus.

17. The draft inducer fan apparatus of claim 16 wherein said flow control means include:

means for creating a combustion product venturi flow area inwardly adjacent said sensing flow opening during operation of said draft inducer fan apparatus with normal combustion product outflow through its discharge opening.

18. The draft inducer fan apparatus of claim 16 wherein said temperature sensing means include:

a hollow sensor housing externally secured to said outlet section and having an interior communicating with said sensing flow opening, and a fluid inflow/outflow opening formed in a wall portion thereof, and a temperature sensor positioned in the interior of said sensor housing to sense the temperature of fluid flowing in either direction between said sensing flow opening and said fluid inflow/outflow opening.

19. A draft inducer fan for a fuel-fired furnace or the like, comprising:

a housing having an inlet opening for receiving combustion products, and an outlet section with a discharge opening therein for discharging the received combustion products, said outlet section having a sensing flow opening formed therein upstream from said discharge opening;

motor-driven means for flowing combustion products through said housing from said inlet opening thereof to and outwardly through said discharge opening thereof;

vane means, positioned within said housing outlet section adjacent said sensing flow opening, for creating a venturi flow area between said vane means and said sensing flow opening to cause an inflow of ambient air through said sensing flow opening during operation of said draft inducer with normal combustion product outflow through said discharge opening, and permit combustion product outflow through said sensing flow opening when combustion product outflow through said discharge opening is impeded; and temperature sensing means, externally associated with said sensing flow opening, for sensing the temperature of ambient air being drawn into said sensing flow opening or combustion products being discharged therefrom.

20. The draft inducer fan of claim 19 wherein said temperature sensing means include:

a hollow sensor housing externally secured to said outlet section and having an interior communicating with the interior of said outlet section through said sensing flow opening, and a fluid inflow/outflow opening formed in a wall portion thereof, and a temperature sensor positioned in the interior of said sensor housing between said sensing flow opening and said fluid inflow/outflow opening.

* * * * *